US005137077A

United States Patent [19]

Sawada

[11] Patent Number: 5,137,077

[45] Date of Patent: Aug. 11, 1992

[54] METHOD OF CONTROLLING FLOW OF MOLTEN STEEL IN MOLD

[75] Inventor: Ikuo Sawada, Kawasaki, Japan

[73] Assignee: Nippon Steel Corporation, Tokyo, Japan

[21] Appl. No.: 622,641

[22] Filed: Dec. 5, 1990

[51] Int. Cl.[5] ..... B22D 27/02

[52] U.S. Cl. ..... 164/466; 164/502

[58] Field of Search ..... 164/466, 502, 498, 147.1

[56] References Cited

FOREIGN PATENT DOCUMENTS 58-217493 12/1983 Japan .
61-222984 10/1986 Japan .
62-254954 11/1987 Japan .
63-154246 6/1988 Japan .
63-230258 9/1988 Japan .
63-260652 10/1988 Japan ..... 164/466
183356 3/1989 Japan .

*Primary Examiner*—Kuang Y. Lin
*Attorney, Agent, or Firm*—Pollock, Vande Sande & Priddy

[57] ABSTRACT

A water-cooled mold for use in continuous steel casting process has at least two vertically-spaced coils arranged in the wall structure of the mold so as to surround molten steel in the mold or in a solidification shell within the mold and such that a jet of molten steel from an immersion nozzle of a tundish in the molten steel collides with the mold wall at a level between the coils. During supplying the molten steel from the tundish into the mold, the coils are supplied with DC currents of opposite directions so as to generate cusp fields in the mold, thereby suppressing the movement of the jet of the molten steel, as well as ascending and descending flows of the molten steel after collision with the mold wall.

2 Claims, 8 Drawing Sheets

METHOD OF CONTROLLING FLOW OF MOLTEN STEEL IN MOLD

BACKGROUND OF THE INVENTION

Hitherto, an attempt has been made for controlling state of flow of a molten steel in a mold by applying a static magnetic field for the purpose of reducing any local deviation or uneven distribution of flow of the molten steel which tends to occur when the molten steel is poured into the mold. In such a method relying upon application of a static magnetic field, it is necessary that a path is formed to enable free flowing of an induction current which is generated as a result of interference between the static magnetic field and the flowing molten steel, corresponding to the outer product $U \times B$ of the flowing velocity U of the molten steel and the intensity B of the magnetic field. For instance, in a method shown in FIG. 6 in which a static magnetic field is applied substantially uniformly, an induction current 6 (see FIG. 7) tends to be generated due to interaction between the static magnetic field and the flow of molten steel. The induction current, however, cannot flow unless a path for circulation of such a current is provided. Consequently, it is necessary to form a bypass current which passes through the region near the wall where the magnetic field intensity is low. In order to obtain the bypass current, it is necessary to use an electromotive force large enough to produce such a current.

FIG. 8 illustrates the distribution of the electric potential $\phi$ which provides the electromotive force for the production of the bypass current. The bypass current ($J_1 = -\sigma \text{grad } \phi$) tends to flow from a region where the potential $\phi$ is high to the region where the potential $\phi$ is low. The actual current J is the sum of the induction current $J_2$ ($\sigma U \times B$) and the current $J_1$ produced by the electromotive force. Thus, the actual current J is expressed as $J = J_1 + J_2 = \sigma(U \times B - \text{grad } \phi)$. In consequence, although the bypass current generated by the electromotive force flows in the region near the wall where the magnetic field intensity is low, a potential gradation (grad $\phi$) which serves to suppress the induction current $J_2$ is formed in the region around the discharge flow of the molten steel, so that the actual current J is reduced in such a region. As a consequence, a reduction is caused in the efficiency of the electromagnetic brake (Lorenz force corresponding to the outer product $J \times B$ of the current J and the magnetic field intensity B). This reduction is generally 50% or greater. In order to obtain the desired electromagnetic force, therefore, it is necessary to apply a larger magnetic force.

In the field of single-crystal growth process in which a single crystal is made to grow and be lifted in accordance with a Czochralski process, it has been proposed to brake a natural convection generated in a melt, as well as forced convection caused by rotation of the crystal or of a crucible, by applying a cusp field as shown in FIG. 9. This art is shown in JP-A-58-217493 and JP-A-61-222984. In contrast to the discharge flow of molten steel in a continuous casting mold, the flow of the melt in the single-crystal growth process occurs in the regions near the walls of the container which has an axisymmetrical configuration with respect to the axis. This cusp field is generated radially and axisymmetrically, by placing upper and lower electromagnets which oppose each other with the same poles, namely with reverse polarity, so as to surround the single-crystal lifting furnace. It is reported that the cusp field provides a high braking efficiency because it acts perpendicularly to the flow of the melt in the region near the wall so as to enable the induction current to flow circumferentially.

The behavior of the melt in the single-crystal lifting process in which convection is caused by heat from the wall and shear stress generated in the boundary between the melt and the wall is entirely different from the behavior of the melt in the continuous casting of steel in which the melt is jetted and supplied from a immersion nozzle into a mold. Therefore, the manner of application of a magnetic field in the single-crystal lifting process cannot give any hint to the manner of application of a magnetic field to the melt in continuous casting process.

SUMMARY OF THE INVENTION

In continuous steel casting process, suppression of the flow of the molten steel in the mold and reduction in the local deviation and non-uniformity of the molten steel, as well as oscillation of the molten steel surface, are quite important factors in order to attain a stable casting by avoiding trapping of powder into the molten steel and concentration of alumina-type inclusions to the slab. The control of flow of the molten steel in a mold requires a high magnetic field intensity or alternatively, a compact construction of the device for applying the magnetic field. The present invention has been achieved to give a solution to these problems.

Accordingly, an object of the present invention is to provide a method of controlling the flow of molten steel in a mold used in continuous casting of steel, which can suppress flow of the molten steel in the mold and reduce local deviation or lack of uniformity of flow of the molten steel, as well as oscillation of the free surface of the molten steel and which can prevent mixing of concentrations of components when different steels of different compositions are cast consecutively.

To these ends, according to the present invention, there is provided a method of controlling the flow of a molten steel in a continuous steel casting process, the method comprising: preparing a water-cooled mold having at least two vertically-spaced coils each having a plurality of turns arranged in the wall of the mold so as to surround the molten steel in the mold or in a solidification shell within the mold and such that a jet of molten steel from a immersion nozzle collides with the mold wall at a level between the coils; and supplying, during the jetting of the molten steel, the coils with DC currents of opposite directions so as to generate cusp fields in the mold, thereby suppressing the movement of the jet of the molten steel, as well as ascending and descending flows of the molten steel after collision with the mold wall.

According to this method, the flow of the molten steel is effectively braked so that the oscillation of the free surface at the meniscus, so that trapping of inclusions and bubbles into the slab is suppressed, thus preventing mixing of compositions when different steels with different compositions are cast consecutively.

The cusp fields generated by the upper and lower horizontal coils which are supplied with DC currents of opposite directions have all lines of magnetic force which have only horizontal components directed towards the center at the plane midst between the upper and lower coils. The cusp fields act perpendicularly to the jet of the molten steel from the immersion nozzle and the flow components of the molten steel deflected by the mold wall. Induction currents generated by the cusp fields flow in the directions perpendicular to the magnetic lines of force and the molten steel, i.e., circumferentially through a horizontal plane. The induction current therefore can freely flow without requiring any specific path. Consequently, a highly efficient electromagnetic braking effect is produced by the interaction between the applied magnetic field and the induction current.

Two or more coils for generating cusp fields may be arranged at levels above and below the level at which the jet of the molten steel collides with the mold wall. The effect of suppression of the flow of molten steel and, hence, the advantages of the invention, are enhanced when a multiplicity of coils are used to generate multiple stages of cusp fields under suitable conditions.

The arrangement may be such that each of the coils are divided into segments and the vertically aligned segments of the coils are connected through connecting portions so as to form independent DC current loops in the respective combinations of the segments, thereby generating at least one cusp magnetic field. Such an arrangement enables the method of the invention to be applied to a variable-width casting operation.

The above and other objects, features and advantages of the present invention will become clear from the following description of the preferred embodiments when the same is read in conjunction with the accompanying drawings.

DESCRIPTION OF THE PREFERRED EMBODIMENT

Figure 1:
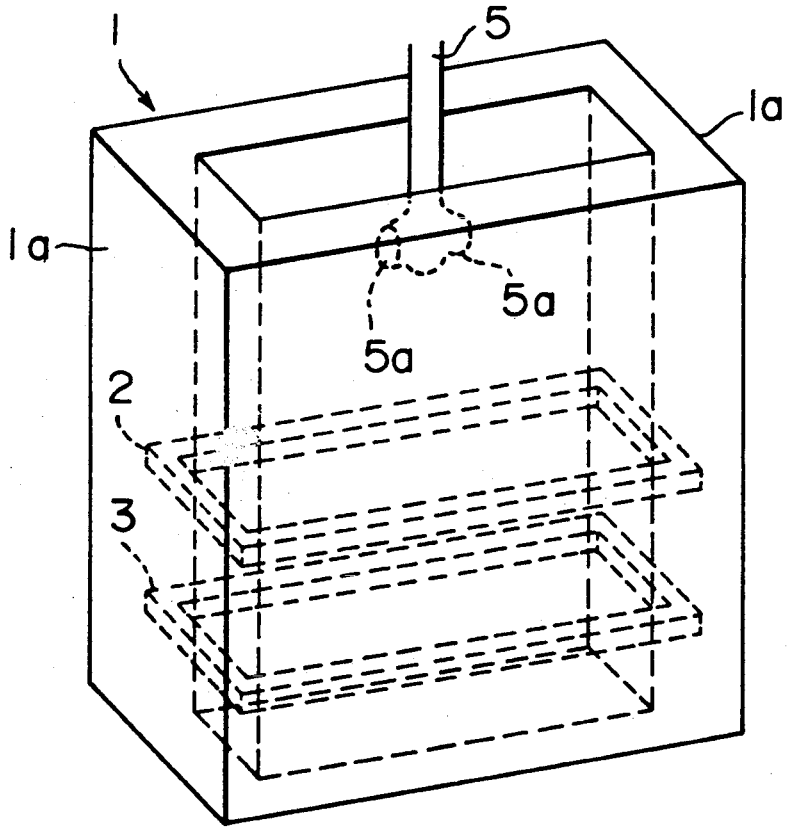
FIG. 1 is a schematic perspective view of an apparatus suitable for use in carrying out the method of the present invention.
Figure 2A:
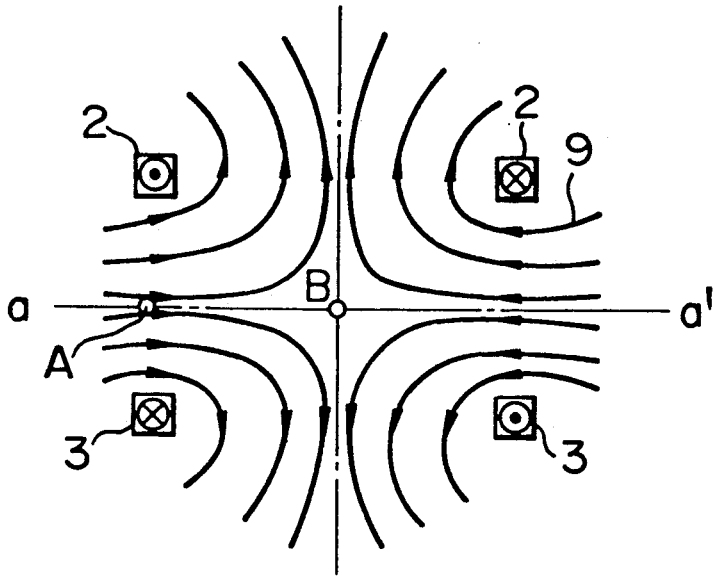
FIG. 2*a* is an illustration of the concept of generation of a cusp field.
Figure 2B:
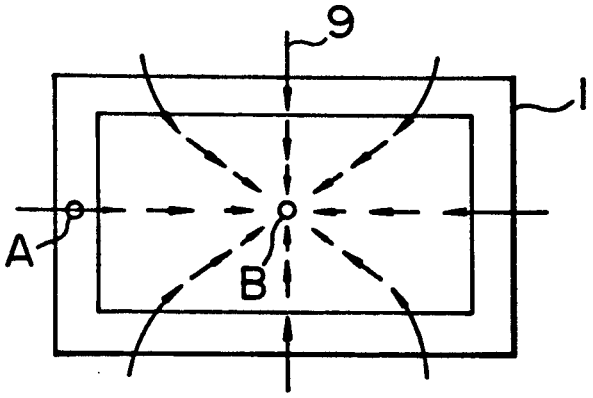
FIG. 2*b* is a sectional view taken along the line a–a' of FIG. 2*a*.
Figure 3A:
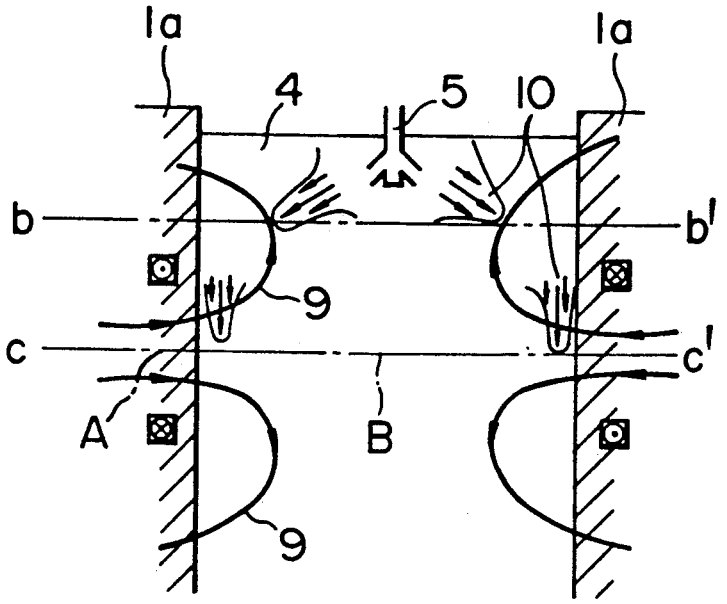
FIG. 3*a* is an illustration of the relationship between magnetic lines of force and the flow of molten steel discharged from a immersion nozzle of a tundish.
Figure 3B:
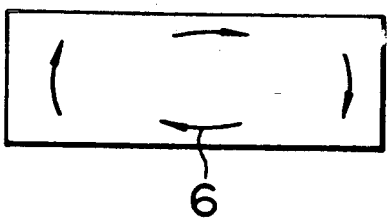
FIG. 3*b* is a sectional view taken along the line b–b' of FIG. 3*a*, showing the state of generation of induction current during braking of non-uniform flow of the molten steel.
Figure 3C:
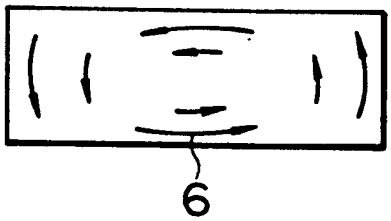
FIG. 3*c* is a sectional view taken along the line c–c' of FIG. 3*a*, showing the state of generation if induction current during braking of non-uniform flow of the molten steel.

FIG. 1 is a schematic perspective view of a water-cooled mold 1 having coils arranged in two stages: namely, an upper coil and a lower coil. The water-cooled mold 1 is adapted to receive a molten steel discharged from an immersion nozzle 5 of a tundish which has a pair of nozzle ports 5*a*, 5*a*. The molten steel discharged form the nozzle ports 5*a*, 5*a* collides with the narrow side walls 1*a*, 1*a* of the mold 1, as will be seen from FIG. 3*a*. Horizontal upper and lower coils 2 and 3 are installed in the wall structure of the water cooled mold over the entire circumference thereof. These coils are positioned at levels which are above and below the level at which the molten steel collides with the mold walls la, la. The coils 2 and 3 ar supplied with D.C. currents which flow in opposite directions each other so that they produce a cusp field as shown in FIGS. 2*a* and 2*b*. The cusp field generate lines of magnetic force which have only horizontal components at the position in the middle of the gap between two coils. All the lines of magnetic force are directed towards the center B of the horizontal plane of the mold. The intensity of the magnetic field is highest at the point A midst of the coils and lowest at the center B. The relationship between the flow 10 of the molten steel and the lines 9 of magnetic force, supplied from the immersion nozzle 5 into the molten steel 4, is shown in a vertical sectional view of FIG. 3*a*. The state of generation of the induction current 6 in the molten steel 4 is shown in FIGS. 3*b* and 3*c* which are sectional views taken along the lines b—b' and c—c' of FIG. 3*a*. The induction current 6 flows in the circumferential direction in a plane perpendicular to the lines of magnetic force 9 and the flow 10 of the molten steel, i.e., within a horizontal plane. Therefore, the induction current is allowed to flow circumferentially without requiring any bypassing path. Consequently, an electromagnetic braking of a high efficiency is effected on the molten steel by the interaction between the applied static magnetic field and the induction current. Specifically high braking effects are produced on the molten steel flowing in the regions near the portions of the mold wall corresponding to the lines b—b' and c—c', due to the fact that the lines of magnetic force perpendicularly intersect each other, as will be seen from FIGS. 3*a*, 3*b* and 3*c*.

Figure 4:
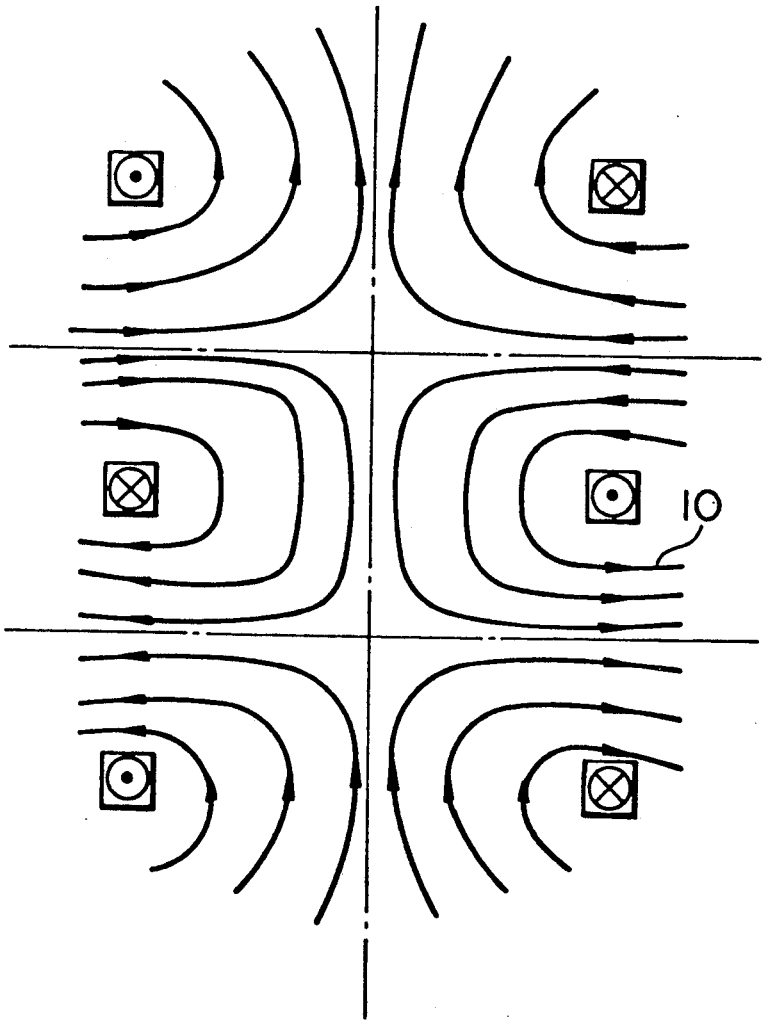
FIG. 4 is an illustration of two cusp fields generated when coils are arranged in three stages.

FIG. 4 illustrates the state of generation of cusp fields generated when the mold wall structure has three coils, i.e., upper, intermediate and lower coils. It is possible to increase the number of coils to generate cusp fields in a multiplicity of stages so as to increase the effect of suppressing molten steel flow, thus enhancing the effect produced by the method of the present invention.

Figure 5:
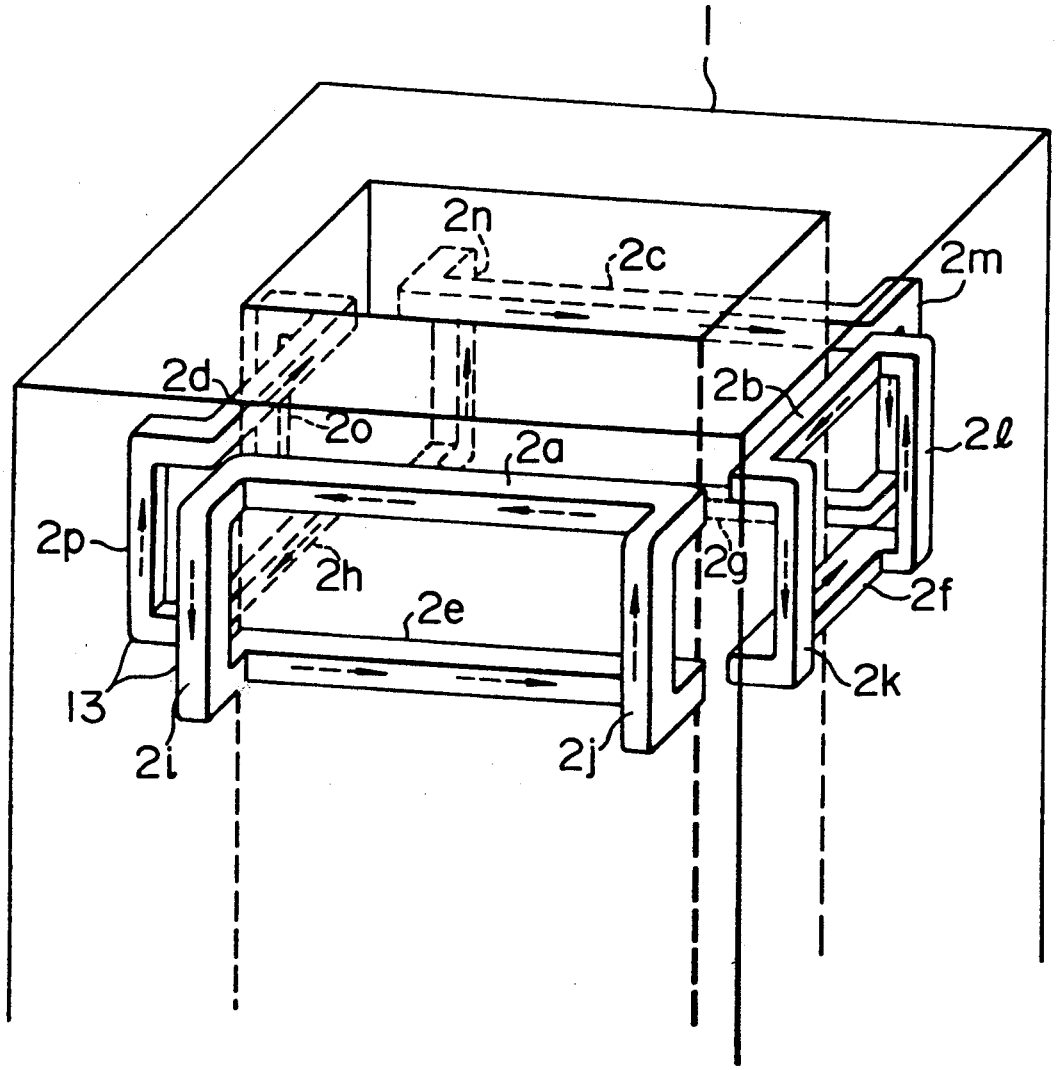
FIG. 5 is a schematic illustration of upper and lower coils each being divided into four segments and corresponding segments of the upper and lower coils are connected.

FIG. 5 shows another embodiment in which upper and lower coils are divided into segments. More specifically, the upper coil is divided into segments 2*a*, 2*b*, 2*c* and 2*d*, while the lower coil is divided into segments 2*e*, 2*f*, 2*g* and 2*h*. The segments 2*a* and 2*e*, 2*b* and 2*f*, 2*c* and 2*g* and 2*d* and 2*h* of the upper and lower coils, respectively, are connected through connecting portions 2*i*, 2*j*, 2*k*, 2*l*, 2*m*, 2*n*, 2*o* and 2*p*. In operation, independent loops of DC current are formed for the respective pairs of segments of upper and lower coils as indicated by arrows, thus generating a cusp field.

TEST EXAMPLE 1

Figure 6:
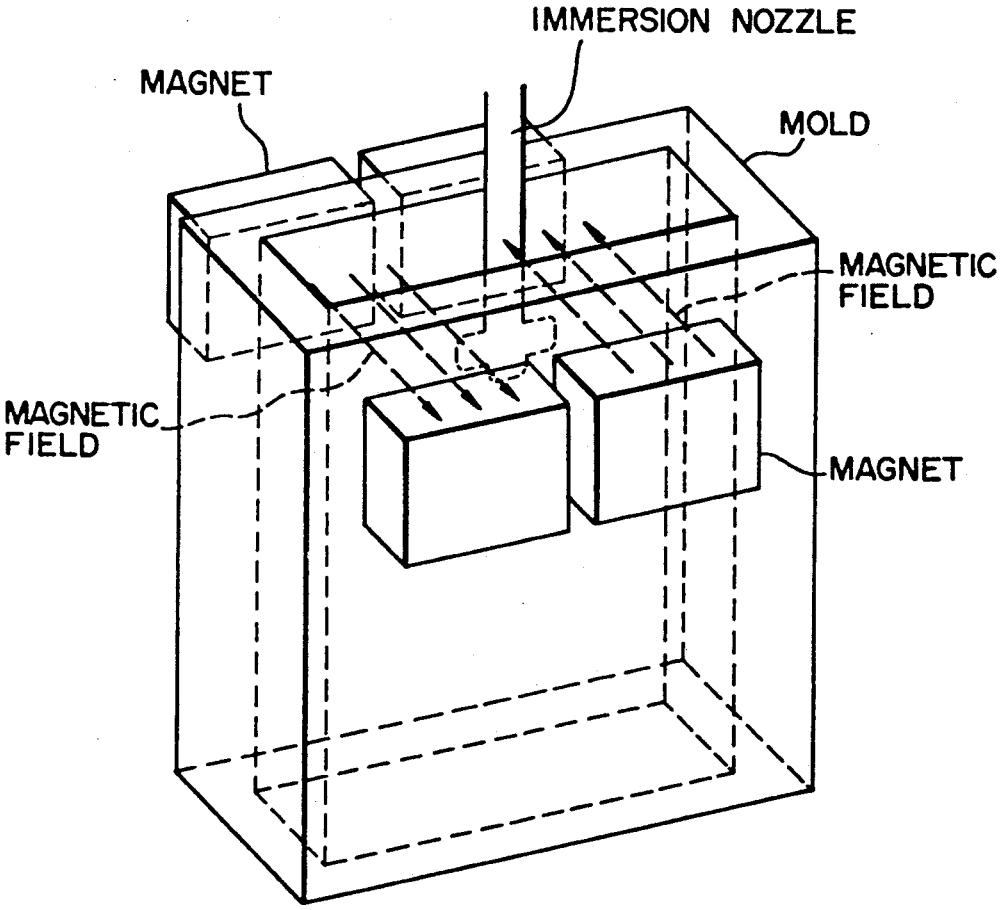
FIG. 6 PRIOR ART
FIG. 6 is a schematic illustration of a known method for controlling the flow of molten steel in a mold by a static magnetic field.
Figure 7:
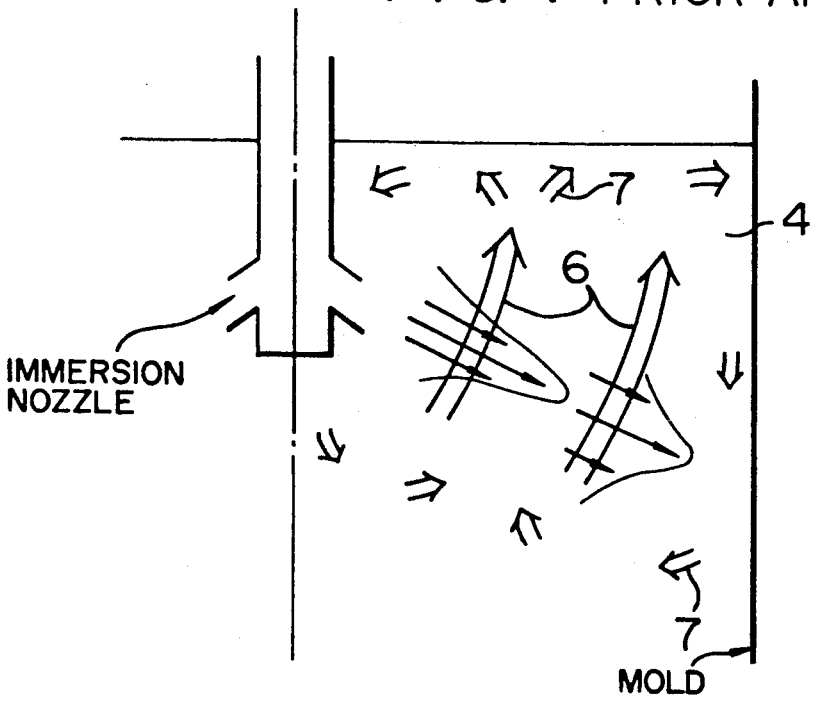
FIG. 7 PRIOR ART
FIG. 7 is an illustration of state of generation of induction current generated in the method illustrated in FIG. 6.
Figure 8:
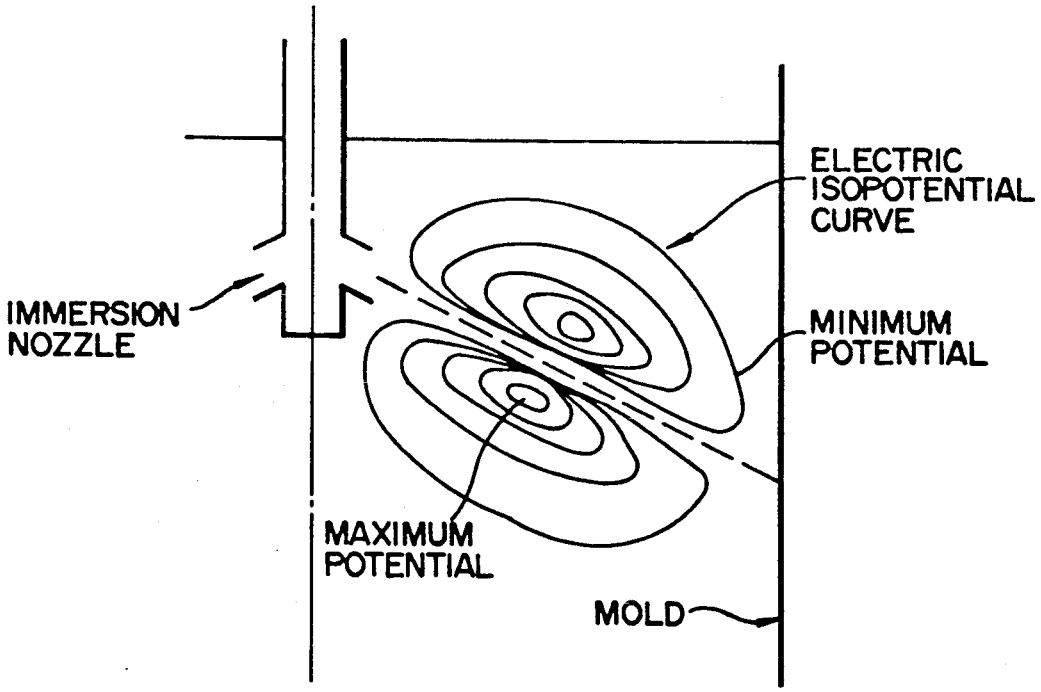
FIG. 8 PRIOR ART
FIG. 8 is an illustration of the distribution of the electrical potential obtained in the method illustrated in FIG. 6.
Figure 9:
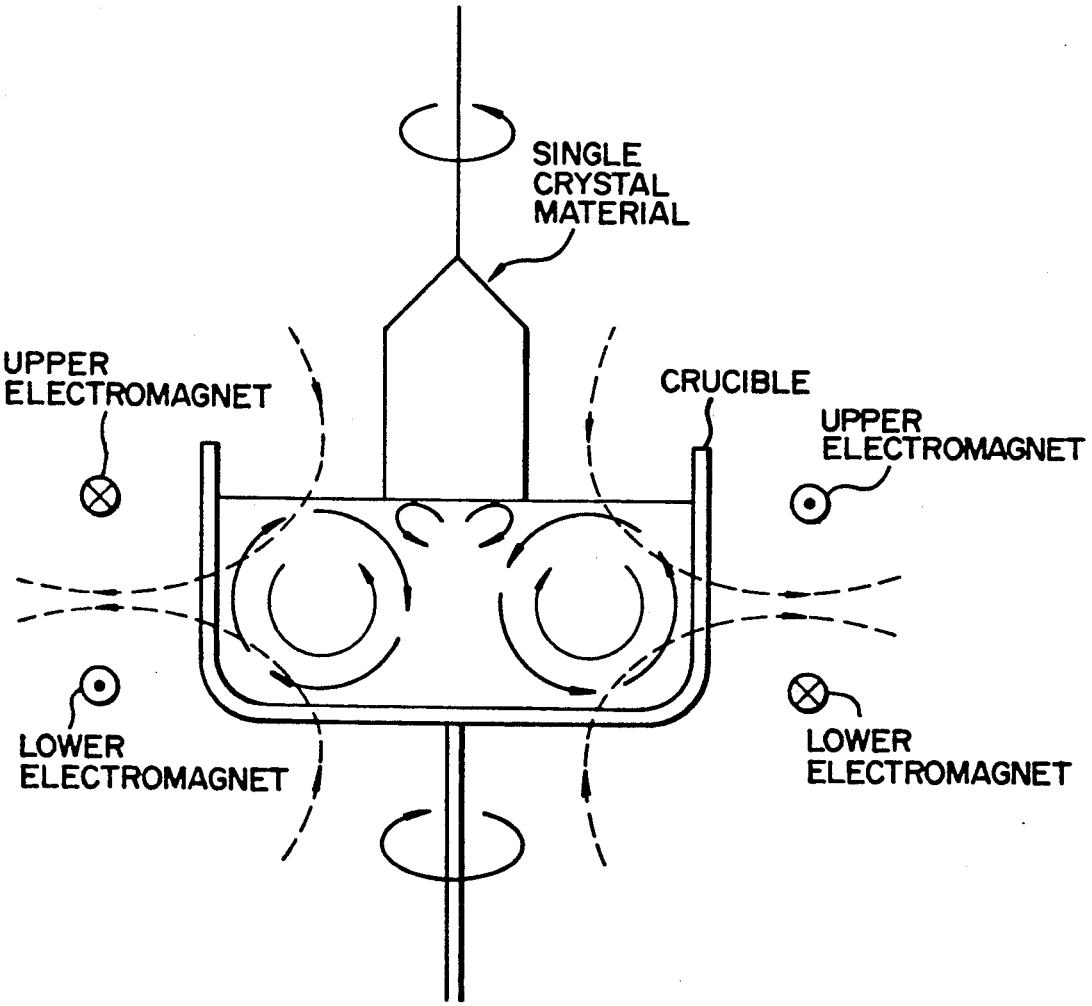
FIG. 9 PRIOR ART
FIG. 9 is an illustration of a single crystal lifting operation conducted in accordance with a CzoChralski process under the influence of a cusp field.

A test was conducted for evaluating the effects of a cusp field under the operating conditions shown in the following Table 1. By way of comparison, a test also was conducted by the known method shown in FIG. 6, under operating conditions as shown in Table 2.

It has been confirmed that the level at which the jet of the molten steel collides with the narrow side walls of the mold is at 500 mm from the meniscus, through measurement of a heat flux conducted by means of thermo-couples embedded in the mold wall structure.

TABLE 1

| Operating Conditions Under Cusp Field | |
|---|---|
| Mold specification | 1800 mm wide, 150 mm thick |
| Immersion nozzle | 300 mm deep, discharge angle 20° |
| Casting speed | 2.0 m/min. |
| Coil position pattern A | Upper coil: 100 mm below meniscus<br>Lower coil: 500 mm below meniscus |
| Coil position pattern B | Upper coil: 300 mm below meniscus<br>Lower coil: 700 mm below meniscus |
| Coil position pattern C | Upper coil: 500 mm below meniscus<br>Lower coil: 900 mm below meniscus |
| Current supplied | 0 to 1000 A to normal condition coil of 100 turns |
| Maximum magnetic field generated in mold | 0.00, 0.05, 0.10, 0.15 Tesla |

TABLE 2

| Operating Conditions of Known Process Under Magnetic Field | |
|---|---|
| Mold | 1800 mm wide, 150 mm thick |
| Immersion nozzle | 300 mm deep, discharge angle 20° C. |
| Casting speed | 2.0 m/min. |
| Coil position | Set at level 400 mm below meniscus and centered at position 450 mm spaced from shorter mold wall |
| Maximum magnetic field generated in mold | 0.30 Tesla |

Castings were conducted under the conditions of Tables 1 and 2 and ingots were extracted from the mold, followed by measurement of amounts of slime of a lumina-type inclusion sin the inclusion accumulation zone which is about ¼ level from the liquid level. The measured amounts of slime were normalized with the value obtained when no cusp field is applied, and the results are shown in Table 3.

TABLE 3

| Amounts of Slime Extracted | |
|---|---|
| When no cusp field is applied | 1 |
| Conventional method 0.30 Tesla | 0.49 |
| Under cusp field (pattern A) | |
| 0.10 Tesla | 0.79 |
| 0.15 Tesla | 0.65 |
| Under cusp field (pattern B) | |
| 0.10 Tesla | 0.45 |
| 0.15 Tesla | 0.23 |
| Under cusp field (pattern C) | |
| 0.10 Tesla | 0.63 |
| 0.15 Tesla | 0.40 |

Castings were conducted under the conditions of Tables 1 an d2 and ingots were extracted from the molds, followed by measurement of amounts of white-blot defects in the surfaces of the extracted ingots. The measured amounts of defects were normalized with the value obtained when no cusp field is applied, and the results are shown in Table 4.

TABLE 4

| Amount of White Blot Defects | |
|---|---|
| When no cusp field is applied | 1 |
| Conventional method 0.30 Tesla | 0.34 |
| Under cusp field (pattern A) | |
| 0.10 Tesla | 1.05 |
| 0.15 Tesla | 0.90 |
| Under cusp field (pattern B) | |
| 0.10 Tesla | 0.42 |
| 0.15 Tesla | 0.22 |
| Under cusp field (pattern C) | |
| 0.10 Tesla | 0.68 |
| 0.15 Tesla | 0.32 |

A test operation also was conducted under the conditions of Table 1 (only pattern B) and Table 2. In the test, steels of different compositions were cast consecutively, and the lengths of the portions of the ingots to be wasted due to mixing of the compositions were measured. The measuring results are shown in Table 5 below, in terms of value normalized with the value obtained when no cusp filed is applied.

TABLE 5

| Lengths of Ingots to be Wasted | |
|---|---|
| When no cusp field is applied | 1 |
| Under cusp field (pattern B) | |
| 0.10 Tesla | 0.64 |
| 0.15 Tesla | 0.48 |

As will be understood from the foregoing data, it was confirmed that the present invention offers the following advantages.

(1) Reduction in accumulation of inclusions in the ingot thanks to the suppression of flow of the molten steel effected by the cusp field.

(2) Reduction in generation of defects in the ingot surface thanks to the suppression of flow and oscillation of the free surface of the molten steel effected by the cusp field.

(3) Prevention of mixing of compositions during consecutive casting of different steel compositions, thanks to the suppression of flow of the molten steel effected by the cusp field.

TEST EXAMPLE 2

Test operations for evaluation was conducted under the conditions shown in Table 6, using the molding apparatus of the type shown in FIG. 5.

Castings were conducted under the conditions of Table 6 and ingots were extracted from the molds, followed by measurement of amounts of slime of alumina-type inclusion sin the inclusion accumulation zone which is about ¼ level from the liquid level. The measured amounts of slime were normalized with the value obtained when no cusp field is applied, and the results are shown in Table 7.

TABLE 6

| Operating Conditions Under Cusp Field | |
|---|---|
| Mold specification | 1800 mm wide, 150 mm thick |
| Immersed nozzle | 300 mm deep, discharge angle 20° |
| Casting speed | 2.0 m/min. |
| Coil position pattern | Upper and Lower coils were divided into four segments, respectively, as shown in FIG. 5. |

TABLE 6-continued

| Operating Conditions Under Cusp Field | |
|---|---|
| | Upper coil: 300 mm below meniscus<br>Lower coil: 700 mm below meniscus |
| Current supplied | 1000 A to normal condition coil of 100 turns (to each coil) |
| Maximum magnetic field generated in mold | 0.15 Tesla |

TABLE 7

| Amounts of Slime Extracted | |
|---|---|
| When no cusp field is applied | 1 |
| Conventional method 0.30 Tesla | 0.49 |
| Under cusp field (coils not divided) 0.15 Tesla | 0.23 |
| Under cusp field (Coils divided) 0.15 Tesla | 0.25 |

It is thus understood that the effect in the reduction of amounts of inclusions is substantially the same, regardless of whether the coils are divided or not.

As will be apparent from the above, according to the present invention, electric currents of opposite directions are supplied to two or more coils arranged around a water-cooled mold used in continuous casting of steel, iron or non-ferrous metal, so that cusp fields are generated to efficiently uniformalize the flow of the molten steel in the mold, while suppressing oscillation of the free surface of the melt in the mold, as well as mixing of compositions when different types of metals are cast consecutively. Both ordinary conductive coils and superconductive coils are equally usable as coils for generating the cusp fields.

What is claimed is:

1. A method of controlling the flow of molten steel in a continuous steel casting process, the method comprising:

preparing a water-cooled mold having at least two coils arranged apart from one another in the wall structure of the mold between which a jet of molten steel collides with a solidified shell within the mold and wherein each of the coils is arranged in a horizontal position and surrounds the molten metal contained in the mold and such that a jet of molten steel from an immersion nozzle of a tundish in the molten steel collides with the solidified shell within the mold at a level between the coils, and during supplying the molten steel from the nozzle into the mold, the coils with DC currents of opposite direction so as to generate cusp fields in the mold, thereby suppressing the movement of the jet of the molten steel, as well as ascending and descending flows of the molten steel after collision with the solidified shell within the mold.

2. A method according to claim 1, wherein each of the coils are divided into segments and the vertically aligned segments of the coils are connected through connecting portions so as to form independent DC current loops in the respective combinations of the segments, thereby generating the cusp fields.

* * * * *